US005659862A

United States Patent [19]

Mahmud et al.

[11] Patent Number: 5,659,862

[45] Date of Patent: Aug. 19, 1997

[54] DEVELOPER ROLL FOR ELECTROPHOTOGRAPHIC COPIERS AND PRINTERS, AND PROCESS FOR MANUFACTURING IT BY POWDER COATING

[75] Inventors: Meftah U. Mahmud, Nashua, N.H.; John F. Coburn, Malden, Mass.; Robert G. Schmidt, Nashua, N.H.

[73] Assignee: Nashua Corporation, Nashua, N.H.

[21] Appl. No.: 308,553

[22] Filed: Sep. 19, 1994

[51] Int. Cl.[6] ..... G03G 13/06

[52] U.S. Cl. ..... 399/276; 399/267; 428/35.8; 428/36.91; 428/36.4; 428/906; 492/8

[58] Field of Search ..... 492/46, 56, 8; 430/99, 106.6; 118/60; 428/36.8, 36.9, 36.91, 36.92, 36.4, 35.8, 35.9, 34.7, 906, 220; 355/251, 253; 399/267, 269, 270, 271, 276

[56] References Cited

U.S. PATENT DOCUMENTS

| | | | |
|---|---|---|---|
| 4,034,709 | 7/1977 | Fraser et al. | 355/251 |
| 4,264,181 | 4/1981 | Lentz et al. | 430/99 |
| 4,430,406 | 2/1984 | Newkirk et al. | 430/99 |
| 4,989,044 | 1/1991 | Nishimura et al. | 355/251 |
| 5,061,965 | 10/1991 | Ferguson et al. | 430/99 |
| 5,141,788 | 8/1992 | Badesha et al. | 118/60 |

FOREIGN PATENT DOCUMENTS 226371 4/1992 Japan .

*Primary Examiner*—Rena Dye

*Attorney, Agent, or Firm*—Robert G. Crooks

[57] ABSTRACT

A developer roll for use in electrophotographic copying machines and printers. The roll has a coating which is electrically conductive. Also disclosed are the materials comprising the roll and its coating, and a process for formulating the materials and for applying them to the surface of the roll by powder-coating.

4 Claims, 3 Drawing Sheets

DEVELOPER ROLL FOR ELECTROPHOTOGRAPHIC COPIERS AND PRINTERS, AND PROCESS FOR MANUFACTURING IT BY POWDER COATING

BACKGROUND OF THE INVENTION

1. Field of the Invention

This invention relates to a developer roll for use in electrophotographic copying machines and printers. It also relates to the materials comprising the roll, and to the process for formulating and manufacturing the coating on the surface of the roll. The roll may be a cylindrical body, but is more likely to be a rigid, hollow cylindrical sleeve or drum, with space therein for accommodating a multi-pole permanent magnet. Provision is made for rotation of the cylindrical sleeve or drum with respect to the permanent magnet. The aforementioned coating is formed by a powder-coating process upon the outer cylindrical surface of the sleeve or drum. The roll in accordance with this invention is especially suited to the transportation and delivery of electrically-charged, magnetically-attractable toner particles to the surface of a photoreceptor drum upon which a latent electrostatic image is to be developed by means of the toner. Although the roll is superbly adapted to the delivery of monocomponent toner to a photoreceptor drum, its utility extends also to the delivery of toners, or developers, comprising a pigment the particles of which are transported by discrete particles of a magnetic carrier.

The present invention is particularly concerned with the formation of the coating on the surface of the roll by electrostatic deposition of materials in finely-powdered form.

As is well known, the four principal steps of electrophotography may be summarized as follows:

1. applying a uniform electric charge to the surface of an insulating photoreceptor;
2. exposing the surface of the photoreceptor to light representing a pictorial image, a page of text, or the output of a digital system such as a computer, thereby selectively discharging portions of the surface of the photoreceptor and producing a latent image defined by surface areas on the photoreceptor which were discharged and other areas which remain electrically charged;
3. developing the latent image by transferring to the surface of the photoreceptor charged, pigmented particles attracted to areas on the surface of the photoreceptor which were discharged (or which remain charged, as the case may be,) thereby converting the latent image into a real and visible image; and
4. transferring the pigmented particles from the photoreceptor to a medium, such as paper, to which the particles become affixed so as to form a permanent record.

The present invention is primarily concerned with novel means for carrying out the third step set forth above, and with the materials and process for constructing such means. In particular, as aforementioned, the emphasis is upon innovations in the structure and composition of the developer roll. However, the significance of the inventive contribution can best be understood in the context of a full explanation of the steps, including developing, of the electrophotographic process. Of the four principal steps, the developing step has probably been the most difficult to optimize. One reason for the difficulty has been the fact that the motion of the particles of toner, while being conveyed by the developer roll and while being delivered to the photoreceptor drum, is determined by mechanical, electric, and magnetic forces of a very complex nature.

2. Description of the Prior Art

In one important type of electrophotographic copying machine, which may with minor modification function as a printer, the pigmented material of the recommended toner is sometimes deposited upon, or formed around, particles of magnetic material such as ferrite or other oxide of iron. In addition to the pigmented material, such as carbon black, and the magnetic material, the toner sometimes also includes a chemical composition for facilitating electric charge of the particles of toner. The purpose of the electric charge on the toner is to take full advantage of the electric forces in the developing stage of the copying machine, to which reference has already been made.

The totality of the pigmented material, the magnetic material, and the "charge-control agent" is referred to as a "monocomponent toner" because it does not require the assistance of a separate and distinct carrier for its transportation through the developing step of the eleetrophotographic process. The developer roll in accordance with the present invention is primarily intended to convey and deliver toner of the monocomponent type.

A developer roll in accordance with the prior art is illustrated in U.S. Pat. No. 4,034,709 of Fraser et al. That patent describes a tubular member of non-ferromagnetic material, such as aluminum, upon the cylindrical surface of which is formed a coating for attracting particles of toner and for conveying them to the location in the copying machine where the particles are to be transferred to the surface of a photoreceptor drum. The developer roll in accordance with the patent to Fraser et al is said to have been designed for use with "dual-component developers." Such developers comprise toner particles mixed with discrete carrier granules, as distinguished from the monocomponent toner for which the developer roll of the present invention is primarily designed. The coating on the cylindrical surface of the developer roll of Fraser et al is composed of styrene-butadiene material. Magnets are disposed within the hollow tubular member of the developer roll in order to attract particles of developer to the outer surface thereof.

Another prior-art patent disclosing a developer roll which is tubular in configuration, for accommodating therewithin a permanent magnet, is U.S. Pat. No. 4,989,044 of Nishimura et al. That patent, which appears to describe the structural organization of a popular copying machine marketed by Canon K.K., acknowledges as prior art the aforementioned relationship between the developer roll and the photoreceptor drum. The patent to Nishimura et al then sets forth a proposed coating for the outer surface of the developer roll (referred to as a "sleeve" in that patent). The coating proposed in the Nishimura et al patent includes fine carbon particles and fine graphite particles dispersed in a resin in such a way that the outer surface of the coating is said to be rough. According to the Nishimura et al patent, the fine carbon particles are included in the coating for their electrical conductivity. The fine graphite particles, on the other hand, are included in the coating "because the lubricant effect of the graphite is so high that the mount of the fine particles attached to the surface of the sleeve is reduced." (Column 11, lines 55 through 57) The specification of the patent to Nishimura et al also makes the following statement in column 14, lines 52 and 53:

"As for the fine conductive particles, fine particles of stainless steel, zinc and other metals are usable."

The specification of Nishimura et al then goes on to describe the "cylindrical base 7" on which the coating is formed, without explaining the above-quoted statement about "fine conductive particles."

3. Relationship of the Prior Art to the Present Invention

In the patent to Fraser et al, the layer 106 of styrene-butadiene having conductive particles dispersed therethrough is applied to the structure of the developer roll by "dip coating or spray coating." (column 8, lines 7 and 8.) The patent to Nishimura et al discloses a developing sleeve 8 made of a cylindrical base 7 of aluminum, stainless steel, or brass coated with an outer coating layer 6. In lines 29 through 32 of column 8, Nishimura et al describe the process for manufacturing the roll as follows:

"The aluminum cylindrical base 7 was sandblasted by ALANDOM abrasive grain No. 400. A coating was applied thereon by a dipping method or spray method in the thickness of approximately 1.0–1.5 microns."

Published Japanese Patent Application Hei 2 (1990)-226371 in the names of Ishihara et al discloses an electro-conductive material for a developer roll of still another type which is said to improve the quality of images formed by electrophotography. The coating material proposed by Ishihara et al contains a binder resin in which are suspended a metal-oxide-type electro-conductive material and a carbon-type electro-conductive material. As examples of the metal-oxide-type electro-conductive material, the published patent application mentions the oxides of zinc, tin, and titanium. The application proposes dip-coating, roll-coating, or spray-coating the electro-conductive material in a mixture including an appropriate solvent such as methanol or ethanol. An important statement concerning the proposed manufacturing process appears in the final four lines on page 6 of the published application, as follows:

"Generally speaking, the electro-conductive material which has been obtained according to the foregoing procedures is utilized in a solvent-solubilized liquid state. It is coated on the surface of a metallic axial body (core metal) at a homogeneous thickness by the dip-coating method, roll-coating method, spray-coating method etc. . . . "

In contrast to all of the three aforementioned examples of the prior art, the present invention contemplates the application of a coating to the substrate of the developer roll in the form of a finely-divided powder which is applied by powder-coating methods without any solvent and deposited evenly upon the cylindrical surface of the developer roll. The significance of this distinction will become apparent in the light of an explanation of the physical operation of the developer roll in an electrophotographic copier or printer.

4. Explanation of the Operation of the Developer Roll

In some existing electrophotographic copiers of the type illustrated in FIG. 2 of the drawings, a multi-pole permanent magnet 11 is fixed in position. The developer roll 13, with its surface coating 15, revolves about multi-pole permanent magnet 11. The sleeve 17 or drum of developer roll 13 may be formed from a non-ferromagnetic metal such as aluminum. Surface coating 15 of developer roll 13 is likewise not strongly ferromagnetic. Accordingly, the lines of magnetic flux from multi-pole permanent magnet 11 penetrate sleeve 17 and surface coating 15 of developer roll 13 and tend to attract to the outer surface of developer roll 13 the particles of monocomponent toner 19 which, as aforementioned, are formed around magnetic cores of material such as ferrite or other oxide of iron. Thus, the particles of monocomponent toner 19 delivered to developer roll 13 from a reservoir or hopper 21 are attracted to surface coating 15 of developer roll 13 and tend to form a layer thereon.

The particles of monocomponent toner 19 are not only magnetically attractable in nature. Very frequently, they are also electrostatically charged with a negative polarity. Such a negative pre-charge may derive from the process by which the particles of monocomponent toner 19 were formed. It may also derive from the handling of the toner particles up to and including the time of their transfer from reservoir 21 to surface coating 15 of developer roll 13. In any event, both the magnetic nature of toner particles 19 and their pre-existing electrostatic charge constitute the initial conditions for the further handling of the toner particles while in contact with surface coating 15 of developer roll 13.

Typically, developer rolls in copying machines are electrically biased by a voltage supply 23 to a level somewhat less negative than the charge on the toner particles. Accordingly, there may be an electrostatic force, as well as a magnetic force, tending to attract toner particles 19 toward surface coating 15 of developer roll 13.

As shown in FIG. 1 of the drawings, developer roll 13 is generally mounted for rotation about a hub 25 and an axis parallel to the axis of a photoreceptor drum 27 (FIG. 2). Developer roll 13 is driven by a motor so that its surface velocity A at the point where developer roll 13 most closely approaches photoreceptor drum 27 is the same as the velocity B of photoreceptor drum 27 at the same point. That is to say, even though developer roll 13 and photoreceptor drum 27 may be rotating in opposite directions, a point on the surface of each is travelling in the same direction and at the same speed as a point on the other when they most closely approach each other. In some electrophotographic copying machines, actual contact is made between the developer roll and the photoreceptor drum. In the type of machine to which the present invention is most clearly applicable, there is likely to be a small gap between the developer roll and the photoreceptor drum.

As developer roll 13 rotates about its axis, it tends to convey the particles of toner 19 that are adhering to the surface of its coating. However, the magnetic field emanating from multi-pole permanent magnet 11, within developer roll 13, is relatively stationary and tends to restrain the particles of toner from being carried along with the full velocity of surface coating 15 of developer roll 13. Consequently, the particles of toner 19 slip slightly on the surface of coating 15 and rub against it. The result of the rubbing between the particles of toner 19 and surface coating 15 of developer roll 13 is a triboelectric charging of toner particles 19 which is cumulative with the charge that they bore when they were attracted to surface coating 15 of developer roll 13.

In some types of copier, such cumulative triboelectric charging causes the particles of toner to form chains extending outwardly from the surface of the roll. Such chains, resembling the bristles of a brush, are most likely to form in copiers designed for operation with dual-component developers in which the particles of toner are carried on the surface of magnetic carrier granules. In fact, this type of charging of toner particles is sometimes referred to as "brush charging."

Above and close to surface coating 15 of developer roll 13 may be mounted a metering blade 29 which is rigidly attached to the metallic structure of the copying machine. Metering blade 29 may be magnetically permeable and may be a part of a magnetic circuit including multi-pole permanent magnet 11 and other structural portions of the copying machine. The flux through the magnetic circuit fringes where it passes through developer roll 13, coating 15 on the roll, and the air gap between surface coating 15 and metering blade 29.

As the "brush bristles" of charged toner particles 19 approach and impact metering blade 29, there is an interaction of a number of different forces upon the particles of toner 19, arrayed in bristles or otherwise. First, there is the mechanical force exerted upon them by surface coating 15 of developer roll 13, which tends to convey them at a velocity approaching the circumferential velocity of the coating. Second, there is the magnetic force attributable to the positioning of particles of toner in the air gap of the magnetic circuit between multi-pole permanent magnet 11 and metering blade 29. Third, there is the electrostatic force exerted by the particles of toner upon one another because of their cumulative charge including the triboelectric charging resulting from friction with surface coating 15 of developer roll 13. Fourth, there is an additional electrostatic force developed by triboelectric charging which occurs as the bristles or chains of toner particles impact, rub against, and are sheared by the edge of metering blade 29. Fifth, there is a still further electrostatic force attributable to: (a) the d-c bias by which the potential of photoreceptor drum 27 is maintained at an average level several hundred volts negative to that of developer roll 13; (b) the a-c bias superimposed upon the aforementioned d-c bias and having a peak-to-peak swing which may exceed the magnitude of the d-c bias; and (c) the electrostatic force attributable to the partial discharge of the surface of photoreceptor drum 27 by photons of light from the optical system of the copying machine, or from a laser light source in the case of a printer.

The physical phenomena which take place as toner particles 19 pass metering blade 29 and approach the point of transfer from developer roll 13 to photoreceptor drum 27 are very complex and difficult to analyze. In addition to the aforementioned electrostatic and magnetic forces, the aggregation of toner particles 19 may be considered to have a "virtual viscosity" which contributes still further mechanical forces besides those which are impressed upon toner particles 19 by the circumferential velocity of surface coating 15 of developer roll 13. It may be assumed that the virtual viscosity of toner particles 19 gives rise to even more triboelectric charging of those particles, and interacts with the electrostatic forces tending to attract the particles to the partially discharged surface of photoreceptor drum 27.

In any event, certain particles jump from developer roll 13 to photoreceptor drum 27 and develop the latent image which exists on portions of photoreceptor drum 27 that have been impacted (or not impacted) by photons of light from the optical system of the copying machine or a laser light source of a printer. Other particles of toner may jump from developer roll 13 to photoreceptor drum 27 but encounter electrostatic forces which cause them to return to developer roll 13. Such forces could be caused by the high negative charge on the unexposed portion of photoreceptor drum 27 or by the large swings of a-c voltage superimposed upon the d-c bias between developer roll 13 and photoreceptor drum 27.

The toner particles "rejected" by photoreceptor drum 27 and returned to developer roll 13 combine with the toner particles which never broke loose from the magnetic forces tending to hold them on surface coating 15 of developer roll 13 and create a problem which will now be explained.

The portions of the surface of photoreceptor drum 27 developed by the jumping toner particles from developer roll 13 proceed, with the rotation of photoreceptor drum 27, to a "transfer station" where those toner particles are transferred to a medium such as paper. Any toner remaining on the surface of photoreceptor drum 27 after passage through the transfer station is removed from the drum by one or more of several cleaning devices that may be provided for photoreceptor drum 27. On the other hand, toner particles remaining on developer roll 13, and which were not transferred to photoreceptor drum 27, are an impediment on a sector of developer roll 13 as it rotates to a station where further particles of toner should be picked up from reservoir 21. Toner particles caught on the surface of developer roll 13 are a hazard if they retain a negative charge that would cause them to repel, or interfere with, the acquisition of further negatively-charged toner particles from reservoir 21.

The lingering of negatively-charged toner particles on developer roll 13 can cause the formation of so-called "ghosts" in future images to be produced from photoreceptor drum 27. As has been explained, the magnetic force exerted by multi-pole permanent magnet 11 tends to attract and retain toner particles on surface coating 15 of developer roll 13. To the extent that such magnetic force is not overcome by the electrostatic attractive force from photoreceptor drum 27, there remains a negatively-charged residue of toner particles which pass the station where the toner was to jump from developer roll 13 to photoreceptor drum 27. If that negatively-charged residue of toner particles on developer roll 13 is not discharged before it reaches the station where the developer roll is to acquire new toner particles, there will be a deficiency in acquisition of new toner particles because they will be repelled by the negative charges remaining on the residue. The failure to acquire the full complement of new toner particles is what causes certain defective portions of copies, commonly referred to as "ghosts."

Now, if the difference of electrostatic potential between the residual negative toner particles and metallic sleeve 17 of developer roll 13 were to decay sufficiently rapidly, there would be no repulsive force between those particles and the toner particles to be newly acquired. Then the troublesome formation of ghosts would not occur. Avoidance of ghosts is one of the objectives of this invention.

If a portion of surface coating 15 of developer roll 13 retains too much negative charge, or if there is a penetration of the toner particles into surface coating 15 of developer roll 13, there may be residual toner particles in surface coating 15 of developer roll 13 when it reaches the station where new toner should be acquired. Such residual toner is sometimes referred to as "non-consumed toner" because it was not consumed in the process of development of the image on photoreceptor drum 27. If the residual "toner fines" were fully discharged, the occurrence of ghosts in the images produced by the copying machine could be eliminated.

The foregoing full explanation has been presented in order to emphasize the importance of the following attributes which should characterize a satisfactory developer roll:

1. the texture of surface coating 15 of developer roll 13 must be such as to convey charged particles of toner and agitate them slightly so that friction between the particles and surface coating 15 will cause triboelectric charging of the particles;
2. surface coating 15 of developer roll 13 must have an electric conductivity sufficient for it to acquire from the metallic substrate of developer roll 13 an electric charge adequate to attract particles of toner from reservoir 21;
3. the electrical conductivity of surface coating 15 of developer roll 13 must be such that electric charge can be at least partially dissipated in a timely manner after the transfer of toner from developer roll 13 to photoreceptor drum 27 and so that negatively-charged non-consumed toner will not prevent replenishment of toner on surface coating 15 of developer roll 13; and 4. the texture of surface coating 15 of developer roll 13 should not be such that "toner fines" will become embedded therein.

Optimum volume electrical conductivity is an objective which workers in the prior art have attempted to achieve. For instance, the '709 patent of Fraser et al provides a developer roll "with a layer of styrene-butadiene having conductive particles dispersed therethrough coated on the exterior circumferential surface thereof." The conductive particles contemplated by Fraser et al are composed of carbon black. The carbon black is applied to the surface of the developer roll by dip-coating, or spray-coating from a solution of styrene-butadiene and carbon black in a solvent such as toluene.

The '044 patent of Nishimura et al provides a developer sleeve having a coating made of resin in which electrically-conductive fine particles are embedded. The fine particles comprise a mixture of amorphous carbon and graphite. The graphite is included in the mixture not only for its electrical conductivity but also because of its lubricity. According to Nishimura et al, the residue of fine toner particles attached to the surface of the sleeve or developer roll is reduced because of the lubricant effect of the graphite. The patent states that "fine particles of stainless steel, zinc, and other metals are usable, . . . ". However, nothing is said as to the purpose of those particles, the amount thereof, their relative desirability, or the mode of their incorporation into the composition of the coating of the sleeve. Moreover, there is no quantization or substantiation of the supposed lubricant effect of the graphite in minimizing the undue retention of fine particles of toner on the surface of the sleeve.

Published Japanese patent application Hei 2(1990)-226371, to which reference has also been made, discloses an electro-conductive coating material for a developer roll of still another type. That coating material comprises a binder resin in which are suspended a metal-oxide-type electro-conductive material and a carbon-type electro-conductive material. As examples of metal-oxide-type electro-conductive material, the published patent application mentions the oxides of zinc, tin, and titanium. The suggested methods of application of the electro-conductive material are dip-coating, roll-coating, and spray-coating in a mixture including an appropriate solvent such as methanol or ethanol.

In the patent of Nishimura et al, incorporation of graphite into the coating of the developer roll is not necessarily consistent with the formation of a surface texture such that particles of toner will be conveyed through the gap between the developer roll and the metering blade. Further, and very importantly, the coatings in accordance with the aforementioned respective examples of prior art were applied from a solution requiring an organic solvent. For reasons which are clear in view of present-day environmental standards, such a mode of application is very undesirable.

OBJECTS OF THE INVENTION

Accordingly, it is an object of the present invention to provide a developer roll having a surface coating characterized by substantial electrical conductivity. In this way, the coating of the developer roll will be enabled to charge quickly and discharge quickly as each incremental segment of the roll moves through the various phases and stations of its complete revolution.

It is another object of this invention to provide a developer roll having a surface coating which is textured so as to charge and also convey particles of toner as they undergo further charging by a metering blade and which, nevertheless, will not permit toner fines substantially to penetrate the surface of the coating and become embedded therein.

It is a further object of this invention to provide a developer roll having thereon a surface coating which can be formulated and applied to the roll without reliance upon volatile organic solvents.

It is a still further object of this invention to provide a developer roll which is not unduly complicated to manufacture, and which is therefore reasonable in cost.

SUMMARY OF THE INVENTION

Briefly, we have been able to fulfill the aforementioned and other objects by providing a developer roll having a surface coating which is applied by electrostatic forces acting upon a carefully formulated mixture of ingredients in powder form. The ingredients of the mixture include amorphous carbon black in a matrix of resin. For additional and more significant electrical conductivity, the mixture also includes flakes of metallic nickel. In blending and otherwise preparing the mixture, the metallic nickel is preferably added in two distinct installments, the predominant addition of nickel to the mixture taking place in the second installment. Great care is taken to insure that the ingredients of the mixture are fully blended, and that their respective particle sizes are reduced to the levels required for the fulfillment of the aforementioned objects. The incorporation of the metallic nickel into the mixture is important because nickel is electrically conductive but is not nearly so chemically active as are other familiar conductive metals such as copper and zinc. Moreover, the choice of nickel in the form of flakes is significant because of its consequences in terms of volume conductivity and texture.

Very importantly, the surface coating of the developer roll is preferably applied electrostatically in powder form, without the use of any solvent.

Finally, the mixture which is to comprise the coating of the developer roll may be quickly applied thereto without contaminating the atmosphere, and may be solidified and cured in a very short time.

BRIEF DESCRIPTION OF THE DRAWINGS

The invention summarized above will be described in detail in the following specification. The specification will be best understood if read while referring to the accompanying drawings, in which.

DETAILED DESCRIPTION OF THE PREFERRED MODE OF CARRYING OUT THIS INVENTION

Figure 1:
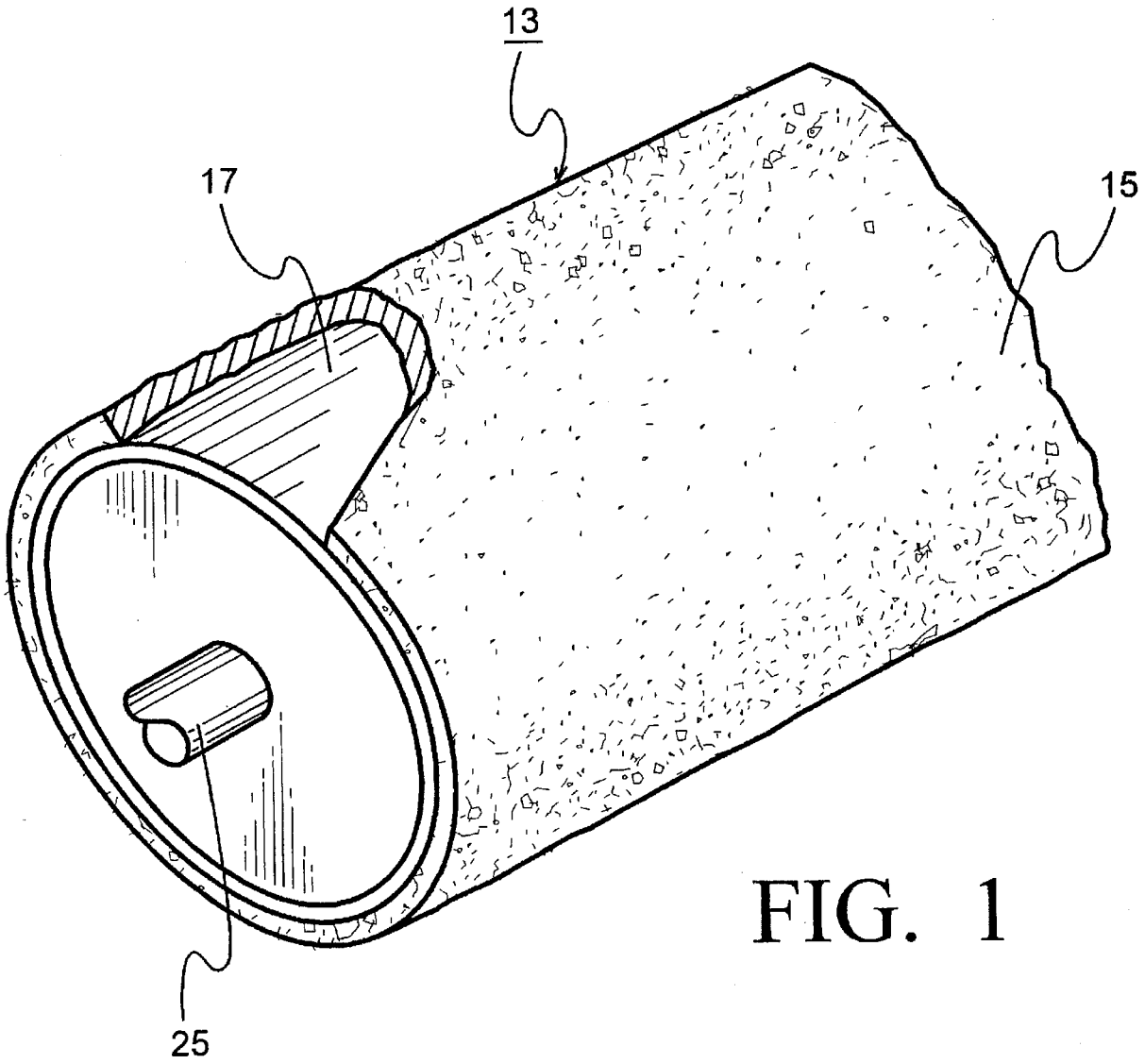
FIG. 1 is a cut-away perspective view of a portion of a developer roll, including an assembly of a tubular metallic substrate with a surface coating thereon.
Figure 2:
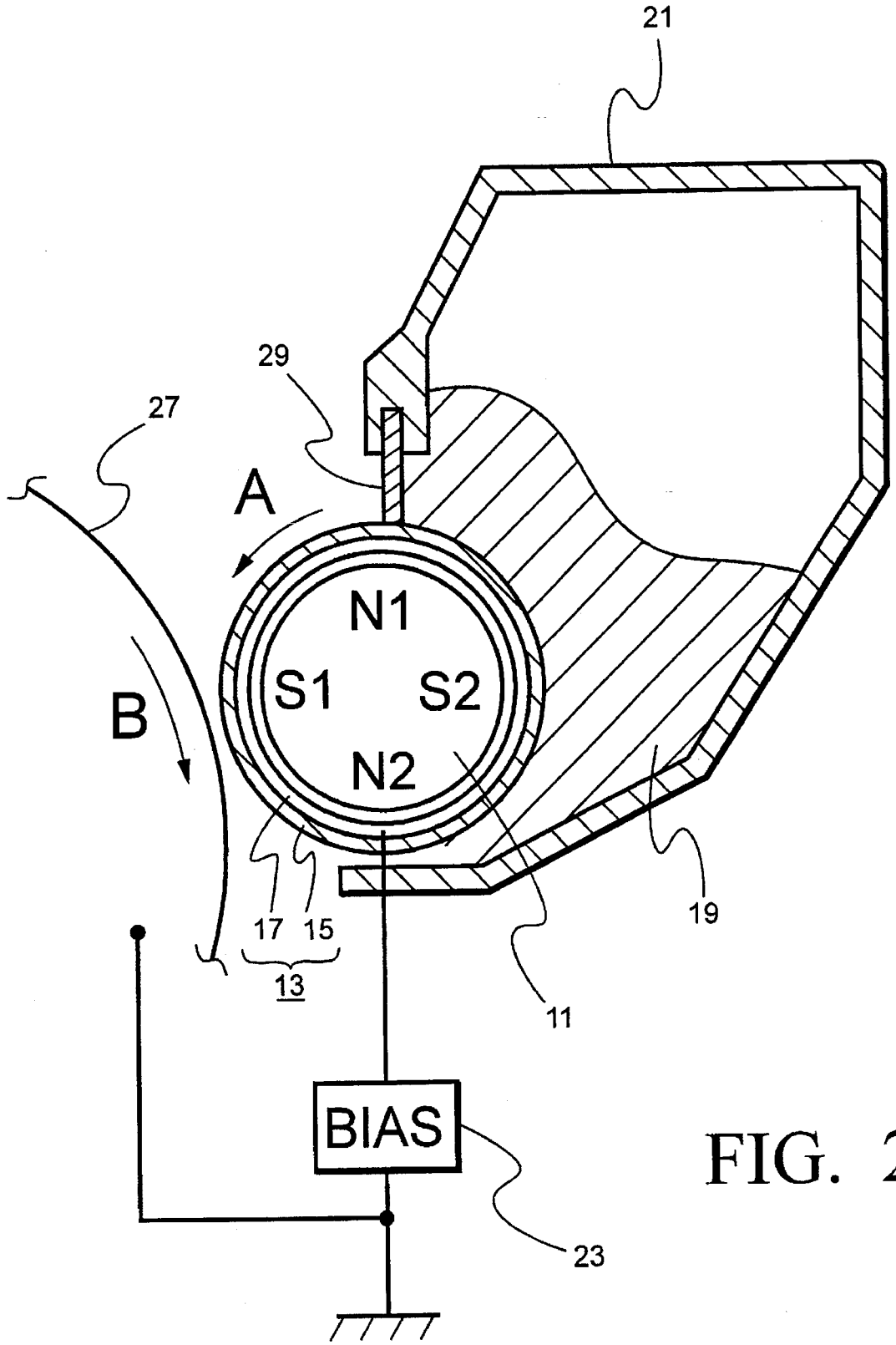
FIG. 2 is a sectional schematic diagram, in elevation, of a simplified copier "engine" of which a developer roll in accordance with this invention is a component.
Figure 3:
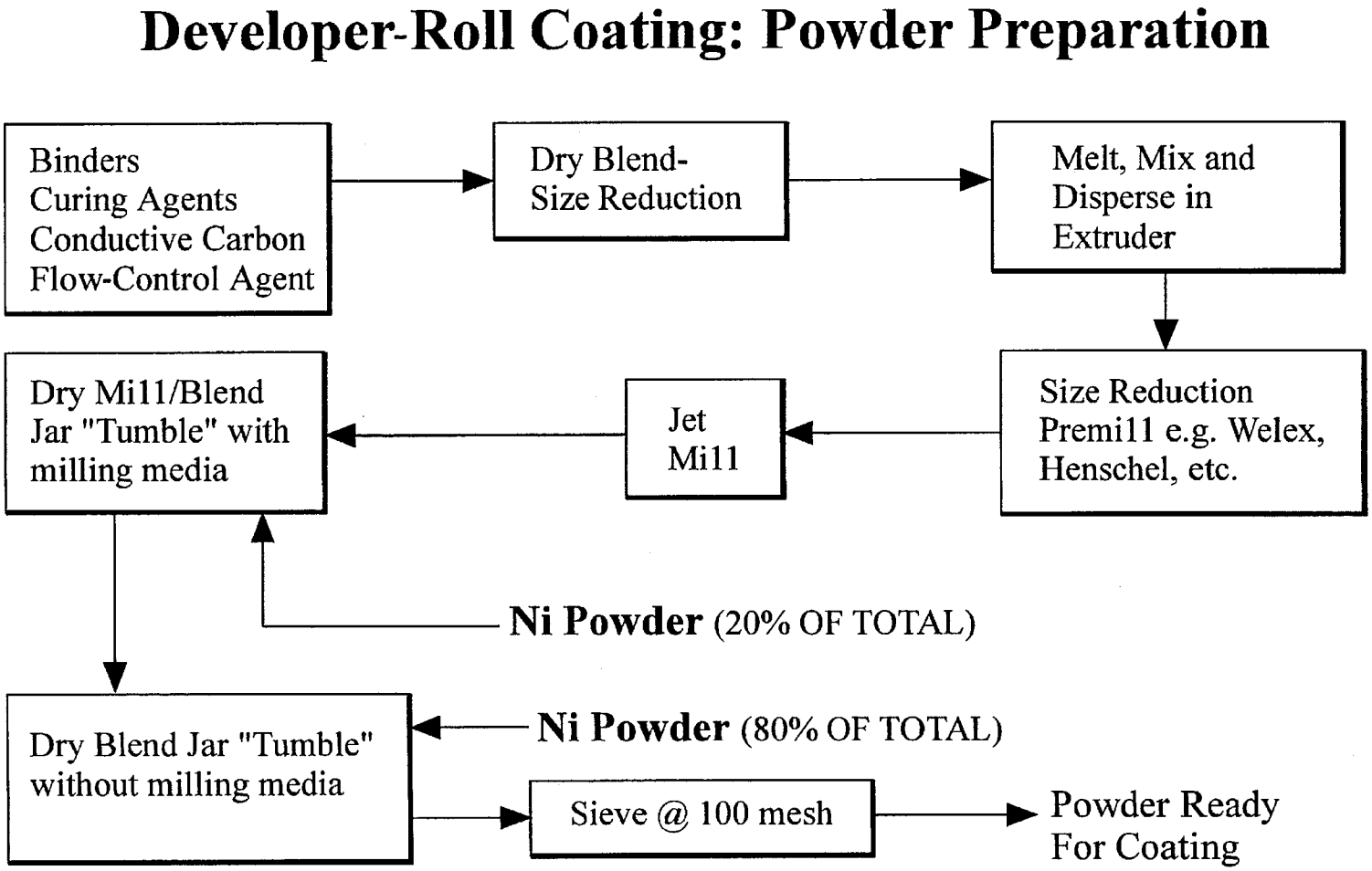
FIG. 3 is a flow chart illustrating the steps of the process that may be employed in the formulation of the coating for the developer roll and in applying it to the tubular metallic substrate mentioned above.

The background has been set forth in detail. The operation which comprises the developing step in the electrophotographic process has likewise been explained in detail. The need for, and fulfillment of, a coating which can be applied to developer rolls without reliance upon solvents has been made abundantly clear in the foregoing paragraphs. The resolution of the problem takes the form of a carefully-formulated powder, including metallic nickel, which can be applied electrostatically to the metallic substrate of the developer roll. The ingredients and the process are as follows:

EXAMPLE 1

The first step in carrying out this example is to blend together, in dry form, five ingredients in approximate weight proportions as shown in the following table.

| Description | Range Weight % | Typical Weight % |
|---|---|---|
| Polyester Resin (e.g. RUCOTE 107) | 60–70 | 63.32 |
| Blocked Isocyanate (e.g. RUCOTE Ni-2) | 10–16 | 14.88 |
| Acrylic-Resin Flow-Control Agent (e.g. RESIFLOW P67) | 1–1.4 | 1.20 |
| Benzoin | 0.50–0.70 | 0.60 |
| Conductive Carbon in Flake Form (e.g. VULCAN XC72R from Cabot Corporation) | 13–25 | 20.00 |

The polyester resin (e.g. RUCOTE 107) is a flake material which is to be reduced to powder form in the next step of the process according to this example. It is designed to react with blocked isocyanate via a hydroxyl functionality. It can be obtained from RUCO Polymer Corporation of Hicksville, N.Y.

2. The blocked isocyanate (e.g. RUCOTE Ni-2) can likewise be obtained from RUCO Polymer Corporation. It has an equivalent weight of 280, and dissociates at 160° C. It acts as a curative agent after first being reduced to powder form.
3. The acrylic-resin flow-control agent (e.g. RESIFLOW P67) should be mixed with silica in weight proportions of approximately 2 to 1, and acts to facilitate flow of the ingredients during the melting process and preparatory to the curing process. It may be obtained from Estron Chemical Company, of Calvert City, Ky.
4. Benzoin is a shorthand name for alpha hydroxy benzyl phenyl-ketone, a white powder which may be obtained from Aceto Corporation of Atlanta, Ga. It facilitates the de-gassing of the blended mixture during and after melting thereof and during subsequent steps of the process. The benzoin serves to prevent the creation of pores in the mixture and in the cured coating, thereby avoiding brittleness.
5. The conductive carbon (e.g. VULCAN XC72R from Cabot Corporation) is one of the most electrically-conductive forms of carbon that are available at a reasonable price. Moreover, the average particle size of the carbon is very small (approximately 30 nanometers), and it consequently has a very large surface area per unit weight (approximately 254 square meters per gram.)

The aforementioned ingredients may be blended in a batch mill of a type known as a "Henschel." The mill should incorporate blunt milling hammers to reduce the size of the particles while carrying out the blending function.

The next step is to feed the output of the mill to an extruder, which continues the dispersion of the carbon particles into the resin of the mixture and which further blends the ingredients as the resin is melted in preparation for the extrusion step. The extruder may have a plurality of heating zones in order to insure the thorough melting of the mixed and blended ingredients.

The extrudate may be reduced to a coarse powder in a further blending or premilling step. The raffled and blended powder is then jet milled to reduce the size of the particles to dimensions between approximately 4 and 10 micrometers.

Having reduced the particle size of the powder to a target level approximating 6 micrometers, the powdered extrudate is next mixed with flakes of metallic nickel in the ratio of between about 1.86 and 9 parts by weight of powdered extrudate for each part of nickel. Optimally, we prefer to use about 2.1 parts by weight of powdered extrudate for each part by weight of nickel flake to form a first nickel mixture. Along with the first nickel mixture, a number of milling media such as alumina rods may be sealed in a dry mill and tumbled for a period of time between about 48 and 60 hours to form a first nickel-bearing powder.

The first nickel-bearing powder is then mixed with a second installment of nickel flakes in an mount between about one and five times as great as the first installment. We prefer to add in the second installment an mount approximately four times as great as the amount of the first installment of nickel that was added prior to the immediately-preceding milling step. That is to say, optimally 20% of the nickel was added prior to the previous milling step and 80% of the nickel is then added to form a second nickel mixture prior to the second milling step. A small mount of treated fumed silica is added to the second nickel mixture to create an aggregate which is then tumbled in a dry mill, to form a second nickel-bearing powder. The treated fumed silica (e.g. CAB-O-SIL from Cabot Corporation) comprises loose particles which serve as "ball bearings" between the particles of the mixture, thereby promoting free flow and further blending of the particles of the mixture.

Finally, the second nickel-bearing powder is sieved through a 100-mesh screen to form the coating powder, ready for application to the developer roll. Preferably, nickel will constitute between 57 and 70 percent of the weight of the coating powder.

Application of the Powder Coating to the Developer Roll

1. As aforementioned, the substrate of the developer roll usually takes the form of a metallic tube so that the multi-pole permanent magnet can be accommodated within it. The tube is frequently made of aluminum, which is not magnetic in the sense that iron, nickel, and cobalt are magnetic. The first step is to polish the outer surface, which may be done with an alumina-coated tape. The final surface roughness should be less than 50 microinches.
2. The tube for the roll is then mounted in a fixture which turns it about a horizontal or vertical axis at a rotational velocity between about 50 and 500 revolutions per minute.
3. The coating powder which has been passed through the 100-mesh screen is then sprayed onto the rotating roll tube by means of an electrostatic spray gun. No binder need be applied to the tube before application of the powder begins. The Nordson powder spray gun is a suitable implement for this purpose. It may be operated at a potential level between 30 and 100 kilovolts and under air pressure of between about 10 and 80 PSIG. Sufficient powder may be electrostatically applied to the surface of the roll within less than one minute when the roll is rotating between about 50 and 500 revolutions per minute. In that period of time, a coating thickness of between about 5 and 100 micrometers will have accumulated.

4. After coating, the roll may be placed in an oven and allowed to cure between temperatures of about 140° C. and 220° C. for periods of between 30 minutes and 5 minutes.
5. Upon completion of the curing step, the roll should be tested for coating thickness, resistivity, and surface roughness. The resistivity will desirably be between about $2\times10^3$ and $2\times10^4$ ohms per square. The surface finish will desirably have a roughness $R_a$ between about 98 and 157 microinches.

EXAMPLE 2

In EXAMPLE 1, the typical weight percentages for the ingredients of the pigment mixture were such that carbon constituted 20% of the mixture prior to addition of the nickel thereto. The proportion of nickel flakes, including both installments of addition respectively before and after the first dry-mill operation, was approximately 40%. In this example, a similar resistivity or conductivity may be obtained by decreasing the percentage of carbon in the pigment mixture to 10%, and by raising the weight percentage of nickel, including both installments, to 70%. In either case, the size of the nickel flakes should range between about 9 and 25 micrometers, but should be centered around a dimension of approximately 15 micrometers. Of course, the nickel flakes are shaped irregularly, and any measurement of their dimension is approximate at best. But they may have an aspect ratio, as between width and thickness, of about 20 to 1. Also, in both examples, the dimension of the conductive Carbon (for instance, the VULCAN XC72R from Cabot Corporation) should be between about 0.03 and 0.3 micrometer. Once again, no carbon in the form of graphite need be employed in the practice of this invention.

In place of isocyanate-cured polyester as a binder for the nickel and the pigment, it would be possible to use similar amounts of other resin systems such as acrylics, epoxies, polystyrene, styrene-butadiene copolymers, styrene-acrylic copolymers, or polymers and copolymers containing carboxylated groups.

A full explanation of the operation of this invention, so far as understood, has been presented in the foregoing specification. Two examples of ratios of ingredients, either or both of which may be regarded as taking full advantage of the principles of this invention, have been described. It will be understood that certain further modifications of the proportions of the ingredients may be made by persons skilled in the art without departing from the principles of the invention.

It is noteworthy, in the two examples which have been described for illustrative purposes, that contributions are made to the electric conductivity of the coating by both amorphous carbon and metallic nickel flakes. The choice of nickel for this purpose is significant in that nickel is electrically very conductive, but not as chemically reactive as copper or zinc. Nickel may be regarded as a "noble metal" and was not at all suggested by reference to certain other metals in the '044 patent of Nishirnura et al. Nickel is available in the form of flakes, which is an advantage in carrying out this invention in practice.

An important feature of this invention which has been stated and is worthy of restatement is the fact that the coating is applied to the roll electrostatically in the form of a finely-divided powder rather than being deposited out of a solution. In the practice of the present invention, neither a solvent nor a primer is necessary in order to hold the coating in place on the outer surface of the metallic roll. The process for practicing this invention is environmentally friendly, and the product thereof is "friendly" to the user of the copying machine or printer in which the roll is incorporated.

Accordingly, the invention to which exclusive rights are asserted is set forth expressly in the following claims which, together with their equivalents, may be taken as the definition of the invention.

We claim:

1. A developer for an electrophotographic copier or printer, said developer comprising:

(a) a multi-pole permanent magnet, and (b) a roll disposed around but separate from said multi-pole permanent magnet, and rotatable with respect thereto, (c) said roll having a substrate of non-ferromagnetic metal with a cylindrical outer surface on which is a homogeneous, electrically-conductive cured coating including at least a finely-powdered resin, finely-powdered conductive carbon, and between about forty percent and about seventy percent by weight of fine metallic-nickel powder, all electrostatically deposited on said cylindrical outer surface without adhesive or binder other than said resin, the particle dimension of said conductive carbon being between about 0.03 and about 0.3 micrometer, and said fine metallic-nickel powder being formed from flakes ranging in size from about nine to about twenty-five micrometers.

2. A developer in accordance with claim 1 in which said finely-powdered conductive carbon and said fine metallic-nickel powder are fixed within said resin of said cured coating.

3. A developer in accordance with claim 1 in which said cured coating is between about five and about one hundred micrometers thick.

4. A developer in accordance with claim 1 in which the electrical resistivity of said cured coating is between about $2\times10^3$ and about $2\times10^4$ ohms per square.

* * * * *